US005159148A

United States Patent [19]

Vinghog

[11] Patent Number: 5,159,148

[45] Date of Patent: Oct. 27, 1992

[54] RECOIL SUPPRESSING MOUNT FOR A MANUALLY OPERATED AUTOMATIC WEAPON

[75] Inventor: Geir Vinghog, Duken, Norway

[73] Assignee: Vinghogs MEK. Verksted AS, Duken, Norway

[21] Appl. No.: 603,672

[22] Filed: Nov. 19, 1990

[51] Int. Cl.[5] ..... F41A 25/10

[52] U.S. Cl. ..... 89/44.01; 89/198; 89/37.14

[58] Field of Search ..... 89/42.01, 44.01, 44.02, 89/198, 37.04, 37.03, 37.02, 37.14

[56] References Cited

U.S. PATENT DOCUMENTS

| | | | |
|---|---|---|---|
| Re. 22,361 | 8/1943 | Salisbury | 89/37.03 |
| 2,273,878 | 2/1942 | Magrum et al. | 89/37.14 |
| 2,644,366 | 7/1953 | Danielsen et al. | 89/44.01 |
| 2,731,829 | 1/1956 | Wigington et al. | 89/37.04 |
| 2,732,766 | 1/1956 | Weiss et al. | 89/44.01 |
| 2,790,357 | 4/1957 | Garrett | 89/44.01 |

FOREIGN PATENT DOCUMENTS 169746 9/1934 Switzerland .

*Primary Examiner*—Stephen M. Johnson

*Attorney, Agent, or Firm*—Dressler, Goldsmith, Shore, Sutker & Milnamow, Ltd.

[57] ABSTRACT

The invention relates to a recoil suppressing mount for an automatic weapon. The mount consists of a cradle assembly supported by a pin assembly to a fork means. There are also provided shock absorber means connecting the inner cradle relative to the outer cradle. The pin and shock absorbers are arranged so that the recoil forces from the weapon are substantially suppressed to prevent the transfer of moment forces from the weapon to the outer cradle to maintain the weapon in the sight line during firing.

1 Claim, 1 Drawing Sheet

RECOIL SUPPRESSING MOUNT FOR A MANUALLY OPERATED AUTOMATIC WEAPON the present invention is related to a recoil suppressing mount for a manually operated automatic weapon.

BACKGROUND OF THE INVENTION

Different designs for mounts for automatic weapons of the above mentioned type are known, partly also specially adapted for stationary or mobile supports. Known mounts, however, suffer from the drawback that the recoil forces from the weapon bring the weapon out of the sight line for the following firing. Known mounts of the above mentioned type also have been less developed with regard to quick and secure operation and for producing a series of shots very quickly.

SUMMARY OF THE INVENTION

With the recoil suppressed mount according to the present invention, however, the recoil from fired shots do not substantially effect the weapon aiming, whereby the mount may be used on different supports, such as a tripod, on rolling vehicles or caterpillars, vessels, helicopters or airplanes. With the mount according to the invention the same rate of fire is achieved independently of the angle of the weapon core line. Also a substantially lighter structure is achieved by the mount according to the present invention as compared to known structures and where the operation of the weapon is very quickly and safely and the weapon also very simple can be adjusted to the trigger mechanism of different weapons. With the recoil suppressed mount according to the invention a substantial dampening of the recoil forces is achieved, in the order of 80 to 90%.

The above described advantages and objects is obtained with the recoil suppressed mount according to the present invention as defined with the features stated in the characterizing clauses of the claims.

DESCRIPTION OF A PREFERRED EMBODIMENT

Figure 1:
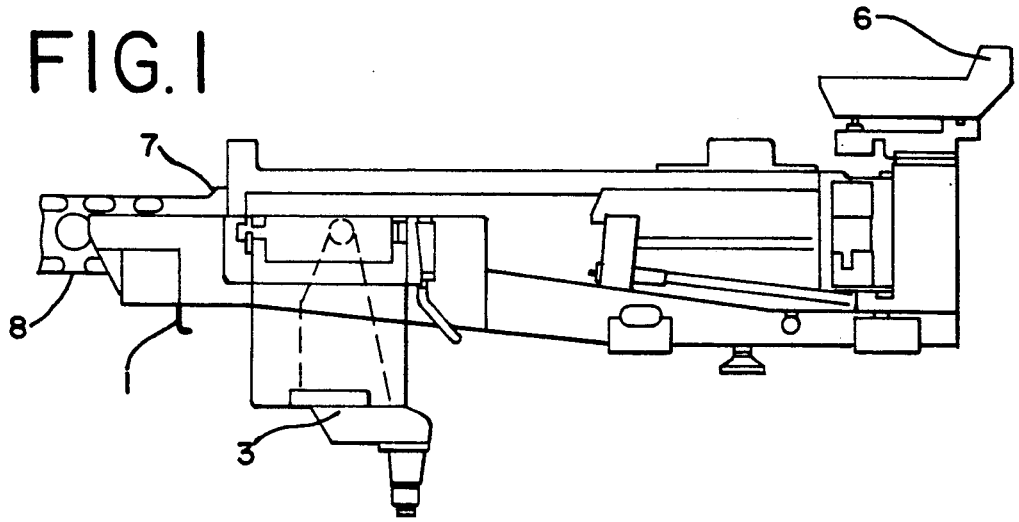
FIG. 1 discloses a side view of the recoil suppressed mount according to the present invention, with a weapon installed, FIG. 2 discloses the mount in FIG. 1 in a top view, FIG. 3 discloses a longitudinal section through the shock absorber in an enlarged scale and FIG. 4 discloses a top view of the front portion of the cradle, in the same scale as FIG. 4.
Figure 2:
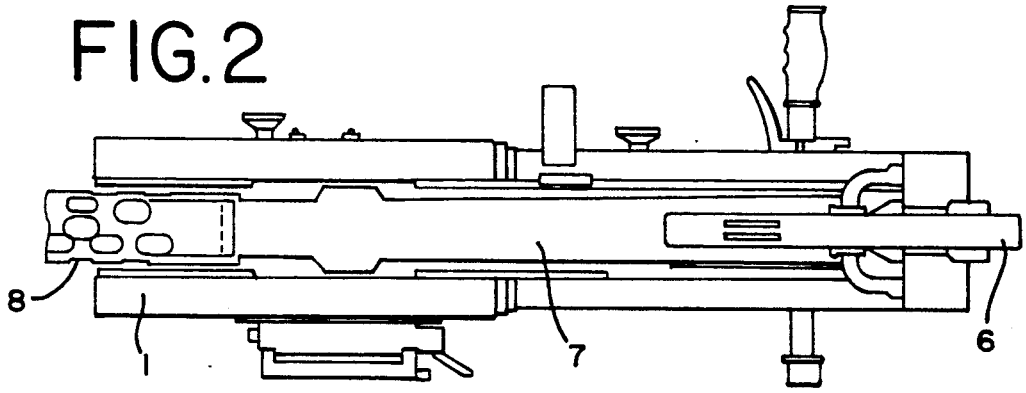
Figure 3:
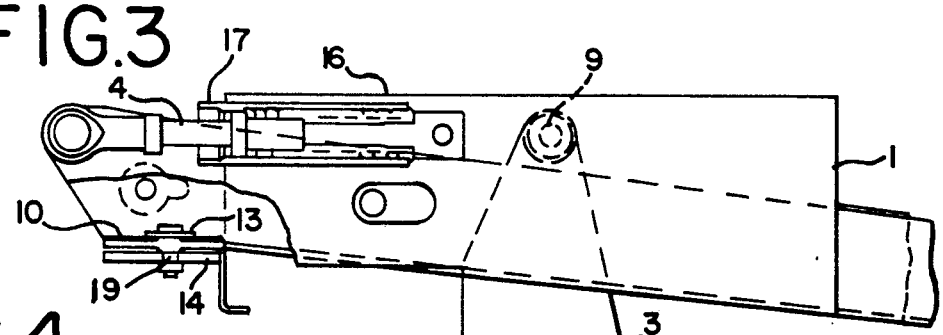

As disclosed in FIG. 1 and 3, the mount is supported on a pivot fork 3 which is turnable secured to a fundament, not disclosed, such as a tripod. The fork 3 is turnable supporting an outer cradle 1 by means of two bearing pins 9 arranged symmetrically and in the same plane as the core line 7 of the weapon 8, whereby the axis of the bearing pins 9 being coaxial and arranged perpendicularly to the core line 7. The outer cradle 1 thereby being able to turn on the bearing pins 9 and assume a desired angle for the core line 7 in relation to the horizontal plane. By means of the pivot fork 3 support in the tripod, the outer cradle 1 can be turned around a vertical axis in relation to the tripod.

An inner cradle 2 is arranged displaceable in the outer cradle 1 by means of front and rear sliding guides. The front sliding guide is disclosed in FIG. 3 and comprises a bolt 19 secured to the outer cradle 1 and protruding through a slot 10 in the inner cradle in such a way that the inner cradle can be displaced in the longitudinal direction of the weapon a limited distance corresponding to the length of the slot, whereby plastics material 13, 14 being arranged between inner and outer cradles and between a washer under the head of the bolt and the inner cradle 2. Additionally sliding bearings 11 and 12 are arranged between the inner and outer cradle in at least one side. In this way a very accurate guiding of the reciprocating movement of the inner cradle 2 in relation to the outer cradle 1 is achieved.

Two shock absorbers 4 and 5 furthermore connect the inner and outer cradles, being arranged symmetrically to the core line 7 of the weapon, of which both are arranged in the same plane as the core line in which plane also the two bearing pins 9 are arranged. The forces transmitted to the mount by firing of the weapon thereby being transferred from the core line 7, through the two shock absorbers 4 and 5 and to the two pins 9, whereby the pivot fork 3 thereby absorbs the rest of the recoil forces not being absorbed by the shock absorbers 4 and 5. As the shock absorbers and the pins 9 are arranged in the same plane as the core line 7 there will, however, not be transferred any moment forces from the recoil to the mount, the mount thereby maintaining the sight line of the weapon also after firing of a shot. A sight 6 is arranged on the rear portion of the outer cradle 1.

Figure 4:
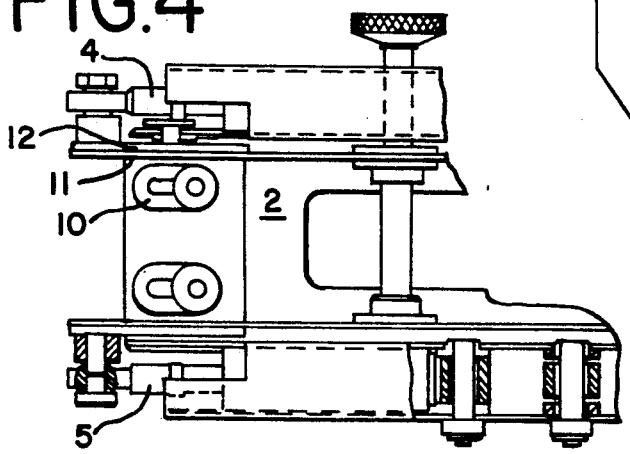

The shock absorbers 4 and 5 are disclosed in FIG. 3 and 4, each of which comprises a helical spring 16 which is compressed by the recoil force whereby the inner cradle 2 thereby displaced rearwards in relation to the outer cradle 1. The helical spring 16 thereafter will bring the inner cradle 2 back to its initial position. The helical spring 16 is arranged in and abutting against the bottom of a cylinder secured to the outer cradle 1 whereas the other end of the spring 16 is abutting against a flange on a rod secured to the inner cradle 2. The flange on the displaceable part of the shock absorber abuts against an elastic packing 17, preferably made of rubber, by the end of this retarding movement of the inner cradle 2. By such a design of the shock absorber, comprising the helical spring 16 and the elastic packing 17, the inner cradle 2 first is moved very quickly by the recoil forces to its rear position and as well very quickly back to its initial position, this movement, however being effectively retarded by the elastic packing 17. As opposed to hydraulic shock absorbers, the shock absorber according to the present invention react very quickly, thereby giving the weapon an increased rate of firing.

I claim:

1. Recoil suppressing mount for a manually operated automatic weapon having a weapon core line, the mount comprising an inner cradle constructed and arranged to receive the weapon, an outer cradle means, for slidably receiving the inner cradle relative to the outer cradle, a base for the mount, a pivotally mounted fork means rotatably supported by said base for receiving the mount, horizontally disposed pin means having a center axis supporting said outer cradle relative to said fork, shock absorber means having a center axis and connecting the inner cradle relative to the outer cradle and disposed symmetrically relative to the weapon core line. characterized in that the center axis of the pins and the center axis of the shock absorber means are arranged symmetrically to and in the same plane as the weapon core line, whereby the recoil forces from the weapon are substantially suppressed without transferring moment forces from the weapon to the outer cradle, thereby maintaining the weapon sight line during firing, each said shock absorber means including a cylinder connected to the outer cradle, a spring in said cylinder, a rod disposed in said cylinder and connected with the inner cradle, said rod having a flange abutting against said spring whereby the spring is compressed when the inner cradle is displaced rearward by the recoil forces, said inner cradle nested within said outer cradle, an elastic packing adjacent said flange, whereafter the helical spring presses the inner cradle into its initial position in which the flange is abutting against the elastic packing, thereby retarding the return movement of the inner cradle to its initial position, and slide bearings arranged between said inner and outer cradles on at least one side of said inner cradle.

* * * * *

UNITED STATES PATENT AND TRADEMARK OFFICE

CERTIFICATE OF CORRECTION

PATENT NO. : 5,159,148

DATED : October 27, 1992

INVENTOR(S) : Geir Vinghog

It is certified that error appears in the above-identified patent and that said Letters Patent is hereby corrected as shown below:

Title page, insert

--[30] Foreign Application Priority Data

May 3, 1988 PCT/NO 88/00035--

Column 1, line 3, "the" should be --The--;
line 52, "FIG. 4" should be --FIG. 3--.

Signed and Sealed this

Twenty-eighth Day of September, 1993

*Attest:*

*Attesting Officer*

BRUCE LEHMAN

*Commissioner of Patents and Trademarks*